US008726600B1

(12) United States Patent
Schmitz

(10) Patent No.: US 8,726,600 B1
(45) Date of Patent: May 20, 2014

(54) CONCRETE CRACK INHIBITING DEVICE

(76) Inventor: Paul W. Schmitz, Sparta, WI (US)

( * ) Notice: Subject to any disclaimer, the term of this patent is extended or adjusted under 35 U.S.C. 154(b) by 185 days.

(21) Appl. No.: 13/134,691

(22) Filed: Jun. 14, 2011

Related U.S. Application Data

(60) Provisional application No. 61/399,247, filed on Jul. 8, 2010.

(51) Int. Cl.

| | |
|---|---|
| ***E02D 27/32*** | (2006.01) |
| ***E04B 1/00*** | (2006.01) |
| ***E04F 13/06*** | (2006.01) |
| ***E04C 5/00*** | (2006.01) |

(52) U.S. Cl.
USPC ..... 52/514; 52/295; 52/287.1; 52/364; 52/713; 52/745.07

(58) Field of Classification Search
USPC ..... 52/294, 295, 287.1, 288.1, 573.1, 364, 52/426, 699, 712, 713, 714, 273, 281, 514, 52/745.07, 475.08
See application file for complete search history.

(56) References Cited

U.S. PATENT DOCUMENTS

| | | | | |
|---|---|---|---|---|
| 2,208,159 | A * | 7/1940 | Lichtor | 52/467 |
| 2,953,835 | A | 9/1960 | Armstrong et al. | |
| 3,254,463 | A | 6/1966 | Moseley | |
| 3,798,867 | A | 3/1974 | Starling | |
| 5,203,640 | A | 4/1993 | Pourtau et al. | |
| 5,623,798 | A | 4/1997 | Crews et al. | |
| 5,743,065 | A * | 4/1998 | Crews et al. | 52/745.05 |
| 6,044,601 | A * | 4/2000 | Chmela et al. | 52/287.1 |
| 6,212,836 | B1 * | 4/2001 | Larson | 52/287.1 |
| 6,318,040 | B1 * | 11/2001 | Moore, Jr. | 52/426 |
| 7,966,773 | B2 * | 6/2011 | Lin | 52/58 |
| 8,191,853 | B2 * | 6/2012 | Long, Sr. | 249/40 |
| 2006/0059850 | A1 | 3/2006 | Minor | |
| 2006/0124825 | A1 * | 6/2006 | Amend | 249/40 |
| 2007/0048493 | A1 | 3/2007 | Melancon | |
| 2007/0094974 | A1 * | 5/2007 | Velickovic | 52/426 |
| 2009/0308011 | A1 * | 12/2009 | Philippe | 52/426 |
| 2010/0050551 | A1 * | 3/2010 | Boeshart | 52/426 |

FOREIGN PATENT DOCUMENTS

| | | | |
|---|---|---|---|
| DE | 4128810 | A1 * | 1/1993 |
| JP | 08093220 | A * | 4/1996 |
| JP | 2008274602 | A * | 11/2008 |

OTHER PUBLICATIONS

Machine Translation of JP 2008-274602 A, date pulled Feb. 14, 2013, p. 1-9.*

* cited by examiner

*Primary Examiner* — Joshua J Michener
*Assistant Examiner* — Elizabeth A Plummer
(74) *Attorney, Agent, or Firm* — M. Paul Hendrickson

(57) ABSTRACT

A concrete re-entrant corner crack inhibiting device for implantation into a re-entrant corner of a casted concrete structure serves to inhibit stress fractures from developing at the cured concrete re-entrant corners. The device includes a re-entrant corning brace for cornering and embedding onto the re-entrant corner, a radial arm radiating outwardly from the brace so to extend into the cement structure and a fracture interrupting unit transversely connected to the radial arm so as to intercept, interrupt and inhibit the development and spread of stress fractures emanating from a cured cement re-entrant corner.

14 Claims, 7 Drawing Sheets

CONCRETE CRACK INHIBITING DEVICE

This application is a non-provisional application of earlier filed provisional application No. 61/399,247, entitled "Concrete Crack Inhibiting Device", filed on behalf of Paul W. Schmitz, on Jul. 8, 2010, the contents of which are incorporated by reference herein.

FIELD OF INVENTION

The present invention relates to stress fracture retardation and more particularly to a device for inhibiting stress fracture from developing at re-entrant corners of concrete structures, concrete structures containing the device and the method of its use.

BACKGROUND OF THE INVENTION

Stress fractures emanating from re-entrant concrete corners (i.e. inside corners) of a cured or dry concrete structure present serious construction problems to the building industry. Such stress cracks occur as shrinkage stresses develop at the re-entrant corners of the concrete slab. As the magnitude of the transformation from a wet to a cured or dry concrete structure, the stress concentration at the re-entrant corners within a concrete slab dramatically increases which results in a high incidence of cracks and fracturing emanating from the re-entrant corners. These cracks are not only unsightly but can result in substantial structural damage. Unfortunately, corrective reconstruction of structural damaging stress fractures may no only be monetarily costly but also costly in time and effort.

To reduce stress cracks at the re-entrant corners of a concrete slab, concrete finishers have chipped the re-entrant corners of the concrete slab in an effort to reduce the sharp edges of the re-entrant corners. While the corner chipping has sporadically reduced or minimized the formation of re-entrant corners stress cracks, such chipping is time consuming and has not proven entirely satisfactory in substantially eliminating the formation of cracks at the re-entrant corners of a concrete slab.

Certain externally disposed re-entrant corner stress reducing devices have heretofore been unsuccessfully proposed to overcome the fracturing of concrete structures at the re-entrant concrete corners. In U.S. Pat. No. 3,254,463 to Moseley, the Moseley patentee was confronted with the problem of how to initially cast concrete wall sections poured in a horizontal position and when they had adequately cured or dried, the subsequent problem of how to vertically reset the casted concrete wall to its vertical wall position without extensively damaging the upended wall by reason of excessive re-entrant corner cracking such as illustrated by FIG. 2 of the Moseley patent.

To eradicate this problem, Moseley proposed to eliminate or replace the casted and cured concrete re-entrant corner with a semi-cylindrical corner insert to purportedly minimize the cracking tendency of the re-entrant corner when subjecting the corner to considerable stress reducing forces such as uplifting a horizontal positioned wall to the standing wall position. Although this technique was purportedly useful in providing prefabricated walls, the creation of a cylindrical cavity at the re-entrant corners was further compounded by requiring corner extension inserts so as to provide the desired square corner structure at the re-entrant corner, all of which added labor and material costs to the construction as well as detracting from the structural utility and strength of the conventional concrete re-entrant corners of a unititary construction.

Another U.S. patent to Crews et al (U.S. Pat. No. 5,623,798) relies upon an externally disposed stress reducing device to reduce stress cracks caused by concrete shrinkage stresses at the re-entrant corners of the concrete slab. The interfacing surface of the Crews et al device contacting the slab in juxtaposition to the re-entrant concrete corner (referred to as the radius of the arcuate contact engaging surface) is defined by Crew et al as measuring about 1 to about 3 inches in length and extends generally the whole width or depth of the concrete slab. The only specific material mentioned for constructing the right angle shaped brace is STYROFOAM which when imbedded into a re-entrant corner of a concrete slab creates a substantially less durable structure than that of a cured concrete re-entrant corner by itself. Due to its externally disposed position and small size, the Crews et al device fails to provide the overall prerequisites and efficacy as required to overcome the creation of stress fractures and structurally damaging cracks emanating from the re-entrant corners of concrete slabs.

SUMMARY OF THE INVENTION

The present invention provides a concrete re-entrant crack inhibiting device which effectively intercepts and prevents the damaging propagation of stress fracture and cracks emanating from a re-entrant corner of a casted concrete slab (e.g. in poured concrete walls and floors). Unlike many of the externally disposed re-entrant corners stress reducing devices heretofore proposed to rectify this perplexing problem, the current device becomes embedded within the concrete slab or structure in juxtaposition so as to intercept and timely arrest the stress fracture to a minimal infraction to the re-entrant concrete corner. Costly stress fracture reconstruction can thereby be effectively avoided by using the crack inhibiting device of this invention.

The present crack inhibiting device includes a re-entrant corner brace which includes mounting means for detachably mounting (e.g. bolts and nuts) the corner brace onto a concrete casting form at the poured concrete re-entrant corner side (i.e. poured) of the form. By centrally positioning the radial extending arm and a stress fracture intercepting unit within the confines of the poured or injected concrete slab, the radial brace and the intercepting unit may be effectively implanted within the poured slab at a centrally disposed position to perform its intended function to retard and inhibit the development of stress fracturing about the re-entrant corner of the cured or dried concrete slab.

The implanted or embedded re-entrant concrete crack inhibiting device of this invention, in effect, creates an internally disposed channeling pathway (e.g. in the form of a radial arm) within which the energy of potential stress fractures emanating from the re-entrant corner are effectively channeled and ultimately intercepted by a fracture intercepting unit. The fracture intercepting unit is sized and positioned in a transverse relationship to the radial arm so as to intercept, retard, and interrupt any substantive development of stress fracturing about the casted concrete re-entrant corner.

To effectively withstand the internal forces crated by the extreme weight of wet concrete mix, the crack inhibiting device necessarily possess sufficient structural integrity so as to maintain its structural integrity and crack inhibiting efficacy in a poured formed concrete structure such as a formed concrete wall, floor or ceiling. A radially extending brace provides a radial brace bridging between the re-entrant corner brace and the stress fracture intercepting plate so as to brace the intercepting plate against collapse due to the weighted forces exerted upon the brace by the wet concrete mix. Further stabilization of the re-entrant corner from stress fractures may be achieved by inserting longitudinal radial intercepting members (such as re-enforcement rods, wires, etc.) to transverse a radii served by the fracture intercepting plate.

After the concrete slab has adequately cured, the implanted device (permanently embedded re-entrant concrete corner) may conveniently detached from the concrete forming frame or form to provide a concrete slab containing the re-entrant corner crack inhibiting device permanently implanted or embedded within cured concrete slab (e.g. such as wall or floor). The device effectively and permanently performs its intended function to retard and inhibit further fracturing or cracking about the re-entrant concrete corner and emanating beyond the intercepting plate.

DETAILED DESCRIPTION OF THE INVENTION

Figure 1:
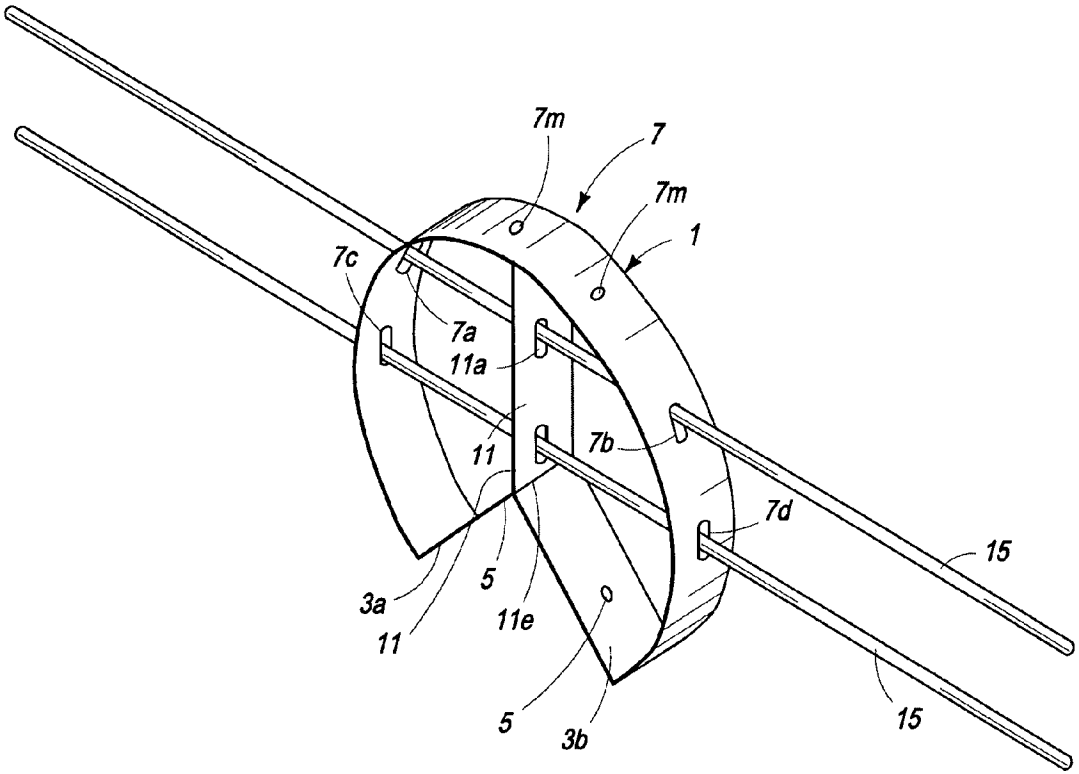
FIG. 1 is an isometric view depicting a re-entrant concrete crack inhibiting device of this invention.
Figure 2:
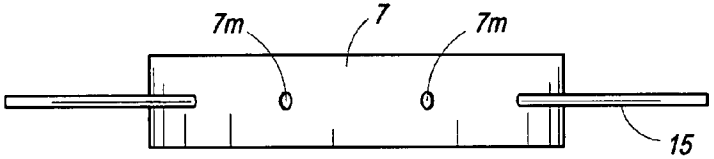
FIG. 2 is a frontal view of FIG. 1.
Figure 3:
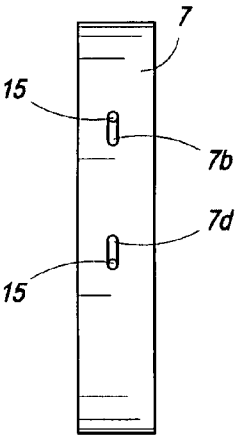
FIG. 3 is a side view of FIG. 1.

With reference to the Figures, the present invention provides a concrete crack inhibiting device 1 for use in inhibiting stress fractures from developing at re-entrant corners RC of concrete structures CD such as commonly arising in poured concrete walls W, floors F, ceilings, etc. The device 1 consists essentially of (a) a mountable re-entrant corner brace 3 equipped with corner mounts 5 for mounting the corner brace 3, and (b) a stress fracture intercepting plate 7 structurally supported by the re-entrant corner brace 3 and radially positioned about said corner brace 3 so as to intercept and retard stress fractures from radiating outwardly from a casted re-entrant concrete corner when the device 1 is implanted therewithin. The cornering brace 3 effectively serves as a base structure for structurally supporting a radial extending arm 11 and the stress fracture intercepting plate 7. The intercepting plate 7 is sized and positioned in a transverse relationship to stress fracturing points emanating and radiating outwardly from the re-entrant corner. The intercepting plate 7 serves to intercept and retard stress fractures from emanating any further from the casted concrete re-entrant corner CD. As may be observed from the Figures, the corner mount 3 provides a mounting member 5 or means for mounting the device 1 to a re-entrant corner concrete forming form CF. The device 1 consequently avoids the disastrous effect of structural damaging stress fractures emanating any further than the embedded device 1 into the casted concrete structure CD.

Figure 5:
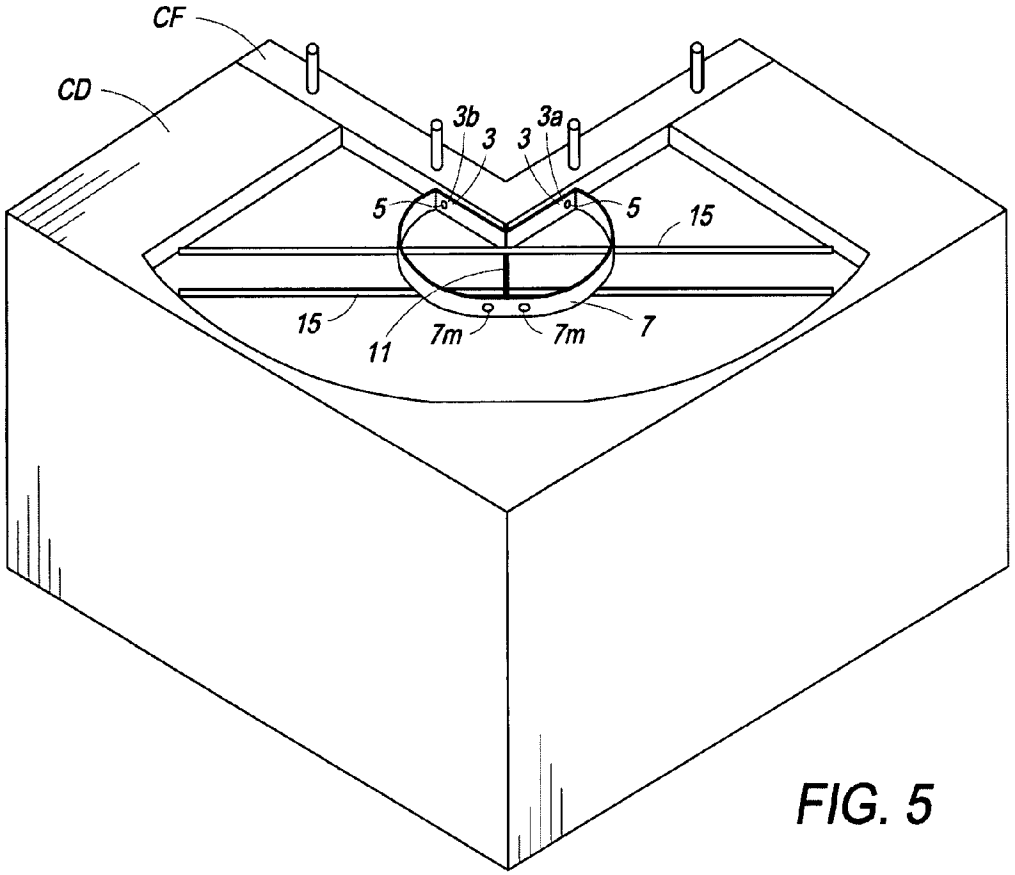
FIG. 5 is a cut out concrete floor portion depicting an isometric top view of the crack inhibiting device shown in FIG. 1 mounted to a concrete floor form.
Figure 7:
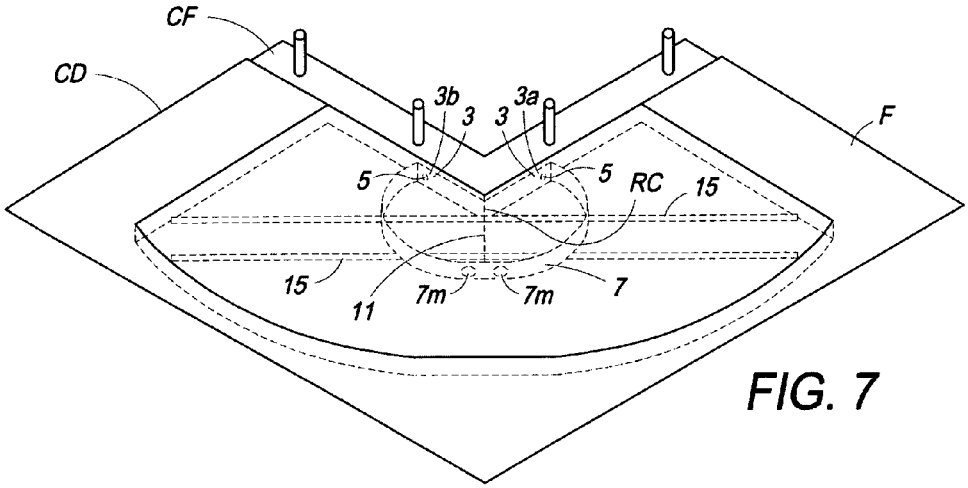
FIG. 7 depicts a cut out concrete floor portion with the phantom lines depicting the concrete crack inhibiting device shown in FIG. 1 embedded within the concrete floor.

The device 1 is adapted for mounting via the corner mounts 5 of the corner brace 3 onto the concrete casting forms CF such as depicted by FIGS. 5 and 7. The device 1 when mounted to a re-entrant corner RC of concrete construction forms CF (e.g. such as commonly used to prepare concrete walls W, floors F and ceilings) will remain anchored onto the casting form CF to maintain the proper positioning of the fracture inhibiting device 1 while the wet concrete is poured or pumped internally within concrete form CF. The device 1 is designed so as to permit the freshly deposited and poured wet concrete to freely flow about the anchored device 1 so as to substantially fill any void or unoccupied spaces about the re-entrant corner RC. Upon curing of the wet concrete within the concrete casting form CF to provide the desired casted concrete structure CD, the device 1 is detached from the form CF and become a permanent fixture firmly embedded therewithin so as to serve as a stress fracture intercepting device 1 to permanently intercept and substantially retard the development of stress fractures emanating and radiating outwardly from the casted concrete re-entrant structure CD. The corner mounts 5 are adapted to allow for detachment of the embedded device 1 from the structure forming forms CF such as by unbolting therefrom.

A radial brace 11 bridging the re-entrant corner brace 3 and the intercepting plate 7 effectively serves as an internally disposed stress intercepting pathway within which the energy of potential stress fractures are internally channeled for ultimately interception and dissipation by the intercepting plate 7. As illustrated by the figures, the placement or anchoring of a terminal end 11*e* of the radial brace 11 to the cornering vertex juncture 3V of the re-entrant corner RC of the corner brace 3 effectively collects stress generating energy at the stress fracture epicenter of the casted re-entrant corner structure CD and therefore more effectively combat concrete re-entrant corner cracking.

In the construction of poured or formed concrete structures, the extreme weight of the wet concrete exerts substantial forces against the device 1 tending to pressure and displace the intercepting plate 7. This necessitates that the device 1 be of a durable construction to maintain its structural integrity. The crack inhibiting device 1 therefore should be accordingly constructed so as to withstand damage to its stress fracture arresting structure when placed under such stressful conditions. The radial brace 11 in cooperative association with the anchoring of the corner brace 3 onto the concrete form CF facilitates in maintaining the intercepting plate 7 at the appropriate stress fracture intercepting and arresting position. As illustrated in the drawings, the radial brace 11 is shown as bridging between the corner brace 3 and the intercepting plate 7 so as to structurally support the intercepting plate against any misalignment or collapse when exposed to those external forces exerted thereby the poured concrete structure while also serving as a pathway of least resistance for stress fractures.

The intercepting plate 7 should be radially positioned and sufficiently sized relative to the re-entrant corner RC size so as to effectively intercept and arrest any damaging development of stress fractures outwardly removed from the positioning of the plate 7 and the re-entrant corner RC. Since re-entrant corner stress fractures are prone to outwardly emanate along a region bisecting the vertex of the re-entrant corner RC, the radiating pathway of the stress fracture once it commences about the re-entrant corner RC will most generally retain its centrally disposed and outwardly emanating position. On infrequent occasions, the re-entrant stress fracture may deviate from its generally bisecting pathway. The radial arm 11 thus serves a useful purpose as a pathway for directionally channeling the stress fracture energy and creation of a pathway of least resistance, namely the radial arm 11, to the fracture intercepting plate 7 for any stress fractures which may develop. In order to further achieve optimum efficacy in retarding structurally damaging stress fractures, the intercepting plate 7 may (as illustrated in the Figures) be arcuately positioned so as to bridge (e.g. radially) between a first leg 3*a* and the second leg 3*b* of the corner brace 3. By radially circumscribing the legs 3*a* & 3*b* of the re-entrant corner RC of corner brace 3, the intercepting plate 7 serves to intercept and arrest or retard any further radial emanation of developing stress fractures irrespective of whatever pathway the stress fracture tends to follow after its inception. The bridging of a radial arc as an intercepting plate 7 between the legs 3*a* & 3*b* can also be effectively utilized to impart significantly enhanced structural strength to the casted concrete structure CD with the embedded device 1 therein.

Since the device 1 becomes firmly implanted or embedded within the set or dry concrete structure CD, the device 1 itself can contribute to additional structural strength to the cured or set concrete structure at re-entrant corner RC. Any development of stress fractures about a re-entrant concrete corner RC will be effectively arrested by the device 1 herein. The device 1 effectively prevents any subsequent deleterious or irreparable re-entrant corner stress fracture structural damage to the concrete structure. The device 1 accordingly, can be effectively utilized to prevent unsafe or code violating concrete structures from occurring which in turn can result in eliminating irreparable structural damage or replacement costs to both the building contractor and owner while also allowing for a more timely and expeditious construction of the structure.

Upon appropriate positioning of an intercepting plate 7 or plate attachment 9 which serves in integral part of the intercepting plate 7, the device 1 intercepts and arrests radial emanating stress fractures which fractures tend to be multi-planar or multi-dimensional in their development. The intercepting plate 7 along (depending upon structure thickness and plate width) or in combination with an intercepting plate attachment 9 of an appropriate width will effectively intercept developing stress fractures throughout substantially an entire depth and width about a re-entrant corner of a casted concrete structure. Since the device 1 becomes embedded within the formed or casted concrete structure CD, the intercepting plate 7 may be correspondingly sized to mate the structural thickness of the concrete ceiling, wall W or floor F about the re-entrant corner RC.

The intercepting plate 7 need not necessarily by of an arcuate structure as depicted by the Figures. The intercepting plate 7 may be fabricated in a variety of different shapes and configurations (e.g. polygonal such as triangular, quad-angular, hexagon, etc.) so as to effectively intercept and arrest an emerging re-entrant crack. If a substantially planar intercepting plate 7 is utilized, the re-entrant brace corner legs 3*a* & 3*b* may be extended to support the plate 7 or the radial brace 11 by itself may be used to fully support a planar or curvilinear intercepting plate 7 of a sufficient size and radial positioning so as to intercept stress fractures emanating from the re-entrant corner RC. Although not necessary, the device 1 may include a plurality of intercepting plates 7 positioned at different angular positions and radii from each other and distance from the re-entrant corner RC.

The intercepting plate 7 should be sufficiently removed or juxtapositioned from the re-entrant corner RC so as to become embedded within the casted concrete structure CD while affording sufficient radial positioning thereabout to intercept and arrest stress fractures emanating about the re-entrant corner RC. As previously mentioned, stress fractures will predominately develop outwardly in a region margining along an imaginary line bisecting the re-entrant corner RC. The intercepting plate 7 as illustrated in the Figures will normally be positioned sufficiently close to the stress fracture origin so as to effectively intercept and arrest such stress fractures from developing into a serious or damaging stress fracture. Conversely, a positioning of the intercepting plate 7 too far from the re-entrant corner RC (e.g. more than about 2 feet) increases the cost of the device while also detracting from its intercepting stress fracture features at or nearest to their point of origin. By positioning the intercepting plate 7 at about less than 20 inches from the re-entrant corner RC and most typically of not more than about 18 inches removed therefrom, substantial control against stress fracture development can be achieved. Conversely, the intercepting plate 7 should be sufficiently embedded within the casted concrete and removed from the re-entrant corner RC to effectively intercept and prevent further radial expansion of a developing stress fracture. For most applications, the intercepting plate 7 will be positioned at least 9 inches and less than 18 inches from the re-entrant corner RC. The radial or angular arc served by the intercepting plate 7 about the primary bisecting stress fracture margin has a more pronounced effect upon effective arresting of stress fractures than the actual radial size of the intercepting plate 7.

Figure 4:
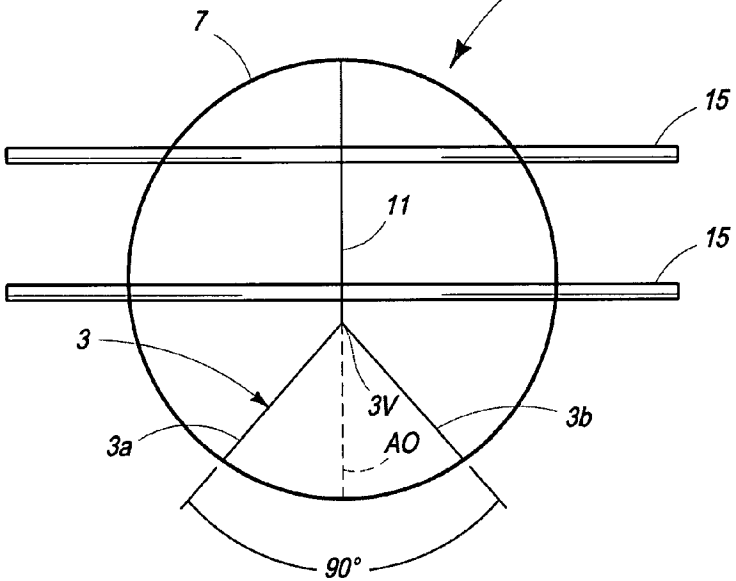
FIG. 4 is a top view of FIG. 1.
Figure 6:
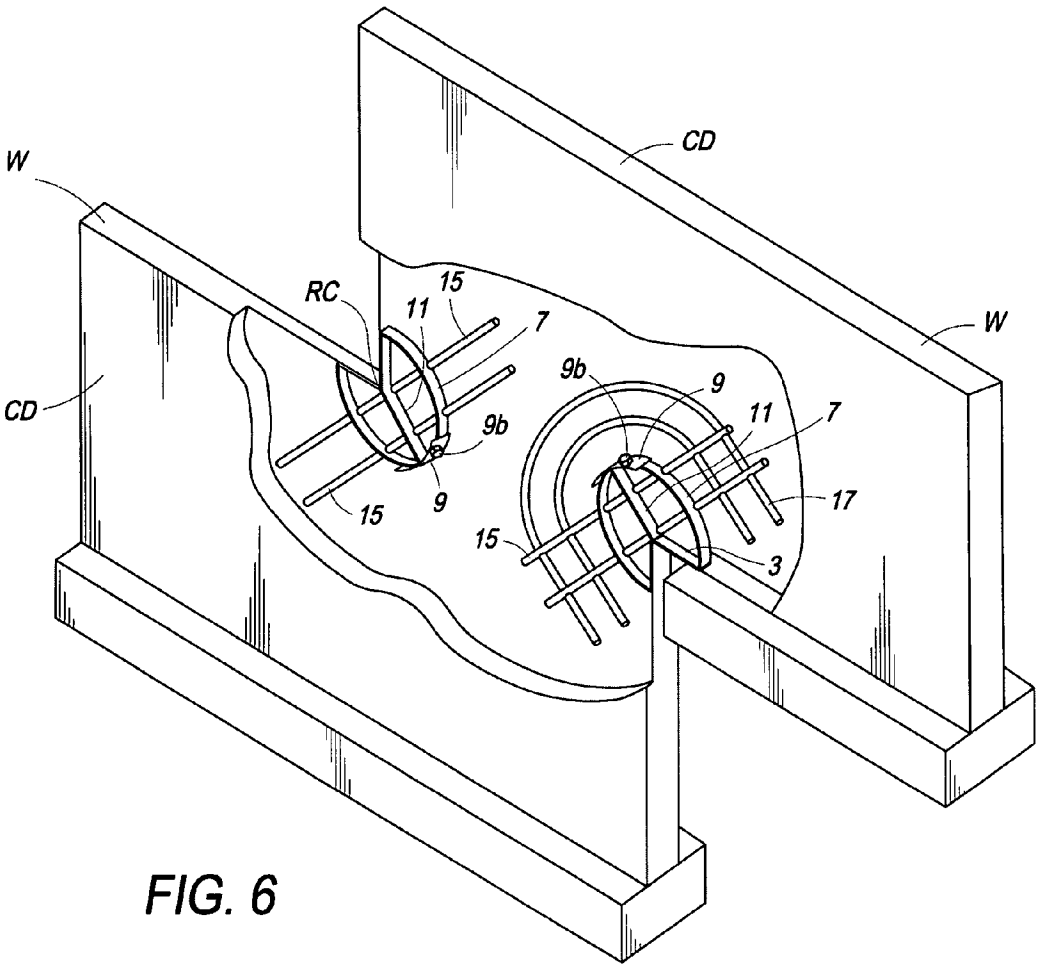
FIG. 6 is a cut out wall portion depicting different aspects of the concrete crack inhibiting devices of this invention each of which includes a mounted stress fracture intercepting plate attachment to accommodate walls of a greater thickness.
Figure 8:
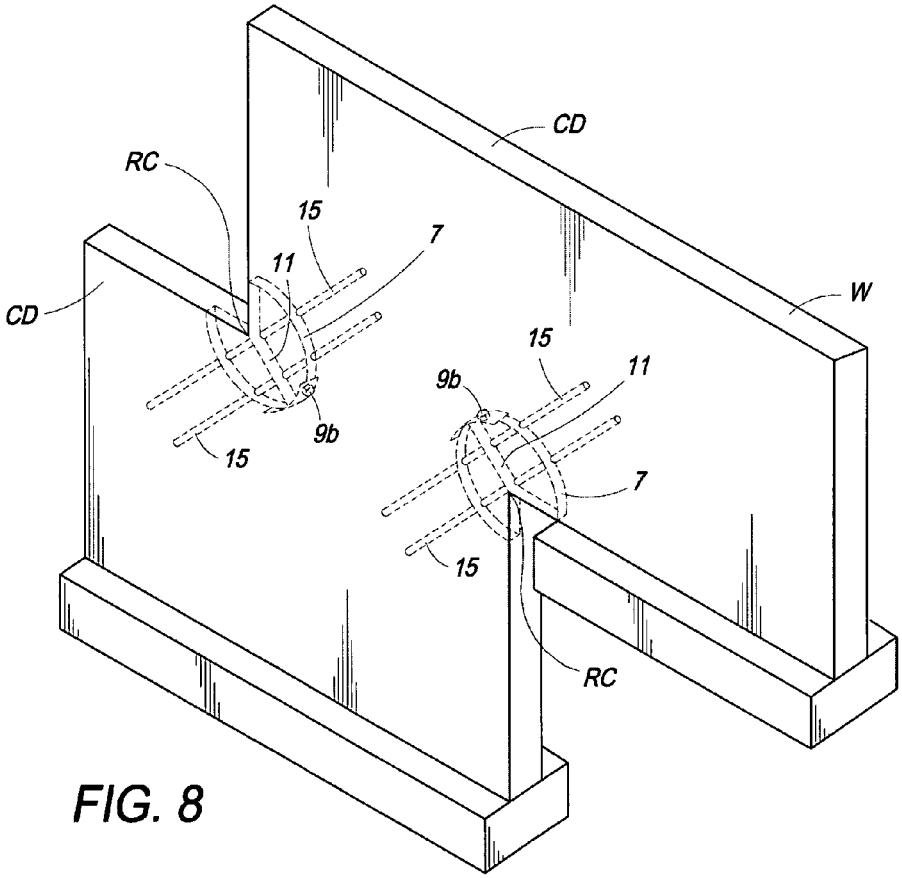
FIG. 8 is an elevational view with phantom lines depicting the two re-entrant concrete corner crack inhibiting devices shown in FIG. 6 embedded within a concrete wall.
Figure 19:
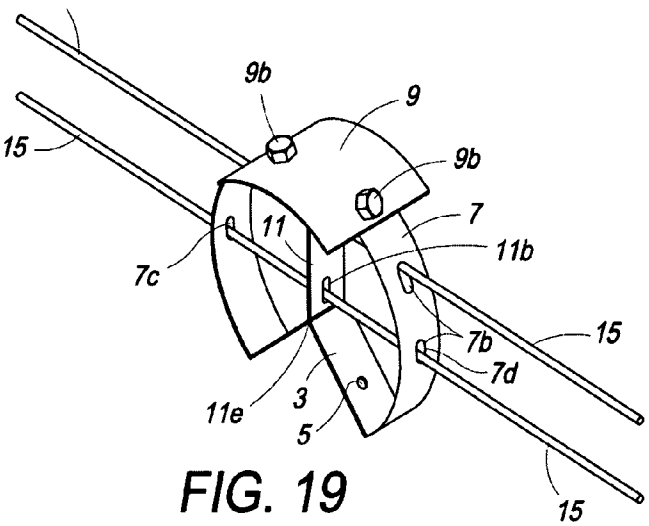
FIG. 19 is an isometric top view of the concrete crack inhibiting device shown in FIG. 1 equipped with an intercepting plate attachment adapted for use in thicker concrete structures.
Figure 15:
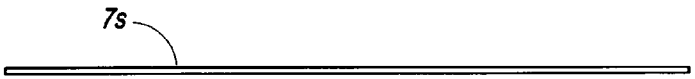
FIG. 15 depicts a side view of an unassembled stress fracture intercepting stock plate for the device shown in FIG. 1.

FIGS. 6, 8 and 19 illustrate the use of an intercepting plate arresting attachment 9 sized so as to accommodate the appropriate thickness of a re-entrant corner RC in a formed concrete structure CD. The intercepting plate attachment 9 may be appropriately angularly positioned and sized so as to serve a region wherein a predominate occurrence of stress fractures will arise. Thus, by placing the intercepting plate attachment 9 along an arc measuring more than about 25 degrees on either side of the bisecting angle of the re-entrant corner RC more appropriately wherein the intercepting plate attachment 9 covers an angular arc of at least 20 degrees of the angular bisect AO between legs 3*a* & 3*b* of the re-entrant corner brace 3 which angular bisect AO as illustrated by FIG. 4 positionally rests along the angular positioning of the radial brace 11.

Figure 17:
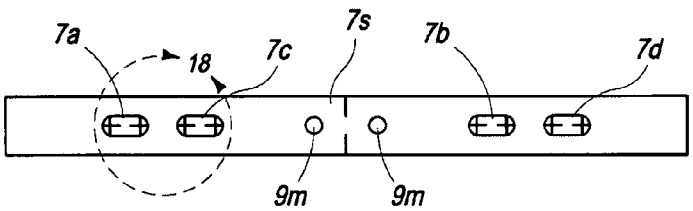
FIG. 17 is a frontal view of FIG. 16.

The intercepting plate attachment 9 serves as a means for permitting a prefabrication of a basic model for the device 1 which may then be readily modified so as to accommodate those variations in thickness of the formed concrete structures CD. The plate attachment 9 may be appropriately provided with an anchoring mount 9*m* for mounting the intercepting attachment 9 onto corresponding mounts 7*m* positioned at a desired intercepting position within the intercepting plate 7. Thus, if the poured concrete wall measured 6, 8, 10 or 12 inches thick, an intercepting plate attachment 9 of a corresponding wall width and arcuate configuration or other appropriate intercepting structure may be conveniently mounted onto the intercepting plate 7 such as via bolts 9*b* such as illustrated in FIGS. 6, 8 and 19. For most applications, the attachment 9 may be appropriately slightly undersized so as to interceptingly mate onto the concrete thickness in which the device 1 is to be used. Thus, for structures 6", 8", 10", 12", etc., thick, an attachment 9 of a square size correspondingly sized to mate the concrete thickness may be adopted for use. If desired, a sufficient intercepting plate 7 width to allow a cosmetic concrete overlaying surface may be used to for this purpose. This, however, is not essential since the overriding consideration is fabricating a plate of a size, placement and configuration so as to effectively intercept and arrest developing stress fractures. A square attachment plate 9 such as illustrated in FIG. 17 or other appropriate intercepting structures performs satisfactorily for this purpose.

There is a pragmatic advantage of fabricating a basic re-entrant corner fracture arresting device 1 which may be easily modified to serve a variety of different concrete structures having re-entrant corners RC of divergent thickness as illustrated by FIGS. 6, 8 and 19. Since the radial arm 11 may effectively serve as an intercepting pathway for channeling the stress fracture energy to ultimate dissipation by the intercepting plate 7, an intercepting plate attachment 9 of a greater width than the base device 1 may be securely mounted to the base intercepting plate 7 to accommodate those structures of greater thickness than that provided by the basic device 1. By providing a basic unit possessing the necessary sturdiness to withstand the tremendous forces exerted by a wet poured concrete structure coupled with the unique stress fracture channeling attributes of the device 1, substantial unit cost savings may be accordingly achieved. The attachment mounting may be simply accomplished by providing the basic device 1 with an intercepting plate attachment mounts 9*m* such as bolt holes for bolting the intercepting plate attachment 9 to the intercepting plate 7 as illustrated by FIGS. 6, 8 and 19.

As illustrated, the intercepting plate attachment 9 need not be of the same length or arcuate configuration as that of the intercepting plate 7. Complete mating onto the base intercepting plate 7 is functionally unnecessary because the stress fracture channeling attributes of radial arm 11 effectively focuses the stress fractures onto the region effectively served by the plate attachment 9. The intercepting plate attachment 9 may be appropriately extended sufficiently in width and depth so as to arrest substantially all of the stress fractures emanating outwardly from the re-entrant concrete corner RC. The focusing of stress fractures to a localized centralized region of the casted re-entrant corner RC significantly reduces the angular positioning requirements of the intercepting plate attachment 9 as well as the intercepting plate 7 to achieve a substantial stress fracture reduction. Covering at least a 20 degree arc about a bisecting radial arm 11 will under most normal circumstances substantially reduce the development of re-entrant corner stress fractures when the attachment is applied to thicker concrete structures that the base unit 1.

Similarly, the radial arm may be appropriately equipped by itself so as to mount a single intercepting plate 7 of the appropriate thickness and angular width for the poured concrete structure in which the plate 7 is to be used to arrest and substantially reduce stress fractures. For most applications, an intercepting plate 7 anchored or affixed to the radial arm 11 so as to cover at least about 75% of the cement structure thickness and an angular arc of about 15 angular degrees on either side of the radial arm 11 (as bisectingly measured from its attachment to the re-entrant corner RC of the corner brace 3) will provide a substantial alleviation against the development of reentrant corner stress fractures. Increasing the intercepting plate 7 width so as to substantially mate onto concrete re-entrant corner RC thickness and increasing the intercepting plate length to encompass at least about 25 angular degrees and of the angular bisect AO and particularly more from about 30 degrees to about 50 degrees of the total angular size (i.e. 270 degrees) between corner leg braces 3*a* & 3*b* positioned at the angular bisect AO thereof enhances the efficacy of the device 1 against stress fracture development under most circumstances. By completely encompassing (i.e. 270 angular degrees) and at least a major thickness of the concrete re-entrant corner with an intercepting plate 7 as illustrated by FIGS. 6 and 8, re-entrant concrete corner stress fractures will effectively alleviate by the stress fracture inhibiting device 1 of this invention.

FIG. 6 further illustrates an added feature to the concrete crack inhibiting device 1 of this invention. By reinforcing the device 1 with a u-shaped re-entrant corner circumscribing re-enforcement member 17 (e.g. a ½ inch 60 grade reinforcement rods), the device 1 will effectively stop any further proliferation of stress fracturing about the re-entrant corner cement structure. In FIG. 6, two circumscribing enforcement members 17 are used at one of the re-entrant corners RC to effectively contain any stress fracture proliferation beyond the device 1 at the re-entrant corner.

Figure 11:
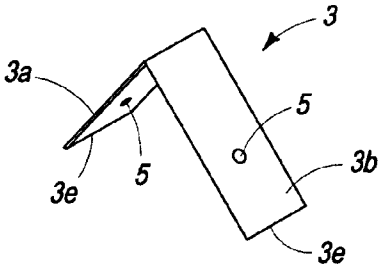
FIG. 11 depicts the corner brace blank shown in FIGS. 9-10 bent to a re-entrant corner brace form.
Figure 12:
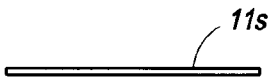
FIG. 12 is a side view depicting a stock of flat steel serving as a radial arm brace for bracing a stress fracture intercepting plate shown in FIG. 1 against the forces exerted by freshly poured concrete.
Figure 9:
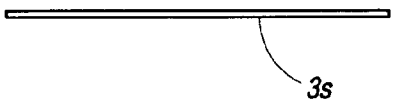
FIG. 9 depicts a side view of strap steel used to fabricate a re-entrant corner brace for the device shown in FIG. 1.
Figure 10:
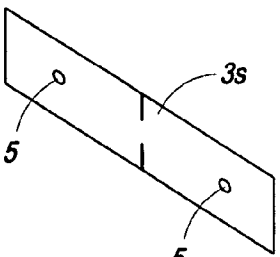
FIG. 10 depicts an elevational side view of FIG. 7 equipped with a bending score line and two drilled concrete form mounting apertures.

FIGS. 9-11 depict a fabrication of a re-entrant corner brace 3 which may be appropriately adapted for most re-entrant concrete corner use in concrete walls or slabs measuring about 3½ inches thick. By mounting a plate attachment 9, this base unit 1 may be retooled so as to accommodate any desired wall or floor thickness. The re-entrant corner brace 3 may be made from strap steel stock 3*s* (e.g. such as of ⅛ inches thickness) such as illustratively measuring 3½ inches by 16 inches with the corner form mounts 5 centered 3 inches from each end. The flat steel stock 3*s* is bent 90 degrees at the bisecting center to provide the re-entrant corner brace 3 shown in FIG. 9. The making of the radial brace 11 is illustrated by FIGS. 10-12 which may for illustrative purposes utilize a ⅛ inch flat steel stock 11*s* measuring 3½ inches wide and 10.63 inches long. Anchoring rod apertures 11*a* & 11*b* measuring 0.625 inch in width centered along at the 1¾ inch bisect with one of the oblong apertures 11*a* being positioned from one end of flat steel stock 11*s* between 3.75 and 4.75 inches and the other 11*b* between 8½ and 9½ inches may be cut into the flat stock 11*s*. The aperture 11*a* & 11*b* apertures were cut to seat onto a ⅝ inch diameter concrete reinforcement rod.

Figure 13:
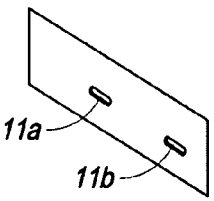
FIG. 13 shows an isometric side view of FIG. 12 with re-entrant rod apertures fabricated therein.
Figure 14:
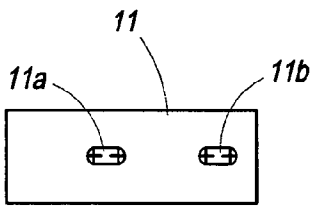
FIG. 14 is a frontal side view of FIG. 13.
Figure 16:
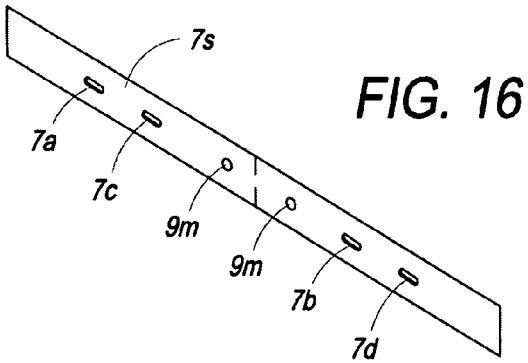
FIG. 16 depicts an isometric side view of FIG. 14 showing plate attachment mounts and re-enforcement rod receiving apertures.
Figure 18:
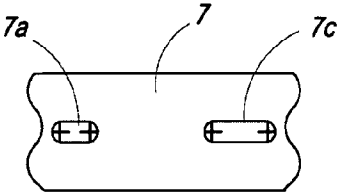
FIG. 18 is an enlarged view of FIG. 17.

The aforementioned intercepting plate 7 such as adapted for formed concrete structures of about 3½ inches or more thick and for receiving re-enforcement rods 15 such as illustrated in FIGS. 1-8 and 19 may also be fabricated as illustrated by FIGS. 15-18 from suitable flat steel stock 7*s* such as one illustratively measuring ⅛ inch thick, 3½ inches in width and 45 inches in length. Four elliptical shaped anchoring rod apertures 7*a*, 7*b*, 7*c* & 7*d* measuring 0.625 inches in width shaped such as shown in FIGS. 16-18 may be respectfully centered and cut between 7.75 inches and 8.75 inches, 12.63 inches and 14 inches, 31 inches and 32.38 inches and 36.25 inches and 37.25 inches from one end which were rounded at the corners 7*c* to seat half of a ⅝ inch diameter concrete reinforcement rod. The flat stock 7*s* for fabricating the intercepting plate 7 may then be appropriately bent into an arc of a constant radius (arcuate bend 18) so as to mate onto each of the ends 3*e* of the cornering brace 3 and place reinforcement apertures 7*a*, 7*b*, 7*c* & 7*d* in linear alignment which may then be welded together or otherwise anchored to provide the device 1 as illustrated by FIG. 1. As illustrated by FIGS. 12-14, the radial brace 11 may then likewise be welded onto a re-entrant corner bisect of the corner brace 3 and the intercepting plate 7 as shown in the drawings.

The reinforcement rod apertures 7*a*, 7*b*, 7*c* & 7*d* in combination with anchoring rod apertures 11*a* & 11*b* may be appropriately sized so as to matingly receive the desired concrete reinforcement rods 15 of an intercepting size. The depicted device 1 may accordingly for illustrative purposes be fabricated to receive a standard sized ⅝ inch reinforcement rods 15. As may be further observed from FIGS. 1, 5-6 and 17, the reinforcement rod apertures 7*a*, 7*b*, 7*c* & 7*d* in conjunction with anchoring rod apertures 11*a* & 11*b* to most appropriately position rods 15 in a transverse relationship to the arcuate intercepting plate 7 as well as the radial arm brace 11. The reinforcement rods 15 when combined with the unique features of concrete crack inhibiting device 1 herein provide additional protection against any further propagation of re-entrant corner fracturing beyond the embedded device 1 including the reinforcement rods 15 embedded along therewith in the casted concrete structure.

Since the crack arresting device 1 facilitates the channeling of developing stress fractures towards an outwardly centralized location which focuses the stress fracture spread predominately about the re-entrant corner bisect or generally about a 135 degree angular position of the obtuse 270 degree angle of the re-entrant corner RC, the device 1 may capitalize upon this unique focusing of stress fractures to a centralized intercepting angular position. An intercepting plate extension or attachment 9 may be centrally mounted onto the intercepting plate 7 to intercept outwardly progressing stress fractures skewing past and which may normally escape interception by the narrower intercepting plate 7. The thicker portion of concrete positioned outside the dimensional width of the intercepting plate 7 of the base unit (e.g. 3 inches in width) will be effectively intercepted and arrested by intercepting plate attachment 9 such as in a 10 inch square attachment 9 (e.g., see FIG. 19) for use in a 10 inch thick poured concrete wall, floor or ceiling such as illustrated in FIGS. 6 and 8.

The basic device 1 depicted in FIGS. 1-5 may be easily modified to accommodate a thicker concrete structure by simply mounting thereto an intercepting plate attachment 9 as depicted in FIGS. 6, 8 and 19. For example, for a 12 inch wall or floor, a 12 inch square piece of ⅛ inch thick flat steel stock may be drilled with ⅜ inch diameter attachment mounting apertures one inch removed from the bisecting margin of the square piece. The square piece may then be bent in to an arcuate shape mating onto the intercepting plate 7 shape. Attachment mounts 7*m* centering onto the 12 inch square attachment along the bisecting angular margin of the intercepting plate 7 may be correspondingly drilled into the intercepting plate 7 so as to mate onto the attachment mounts 9*m* (occluded from view). The attachment 9 may be conveniently bolted with bolts 9*b* onto intercepting plate 7 to provide a device 1 suitable for accommodating structures of a 12 inch thickness.

What is claimed is:

1. A casted concrete structure containing at least one casted and cured concrete re-entrant corner having embedded therewithin a re-entrant corner crack inhibiting device for inhibiting the development of stress fracturing about the casted and cured concrete re-entrant corner, said device comprising a re-entrant corner brace having two legs cornering onto the casted and cured concrete re-entrant corner, a radial arm radially extending inwardly from said re-entrant corner brace onto an arcuate fracture intercepting plate supportively bridging between the two legs of the re-entrant corner brace to provide a radially bracing thereof, with said arcuate fracture intercepting plate being sized and positioned in a transverse relationship to said radial arm so as to intercept and retard the development of stress fractures about the casted concrete re-entrant corner.

2. The casted concrete structure according to claim 1, wherein the re-entrant corner crack inhibiting device includes a mounted intercepting plate attachment of a wider intercepting width than an intercepting width of the arcuate fracture intercepting plate.

3. The casted concrete structure according to claim 1, wherein the re-entrant corner crack inhibiting device includes mounted elongated re-enforcement members mounted to said re-entrant corner crack inhibiting device in transverse relationship to the re-entrant corner.

4. The casted concrete structure according to claim 3, wherein the elongated re-enforcement members consists of re-enforcement rods.

5. A re-entrant corner crack inhibiting device for cornering onto a re-entrant corner of a concrete casting form so as to inhibit the development of stress fracturing about a casted concrete re-entrant corner when embedded therewithin, said re-entrant corner crack inhibiting device comprising a re-entrant corner brace having two legs for cornering onto the casted concrete re-entrant corner, a radial support arm radially extending from said re-entrant corner brace onto an arcuate fracture intercepting plate being sized and positioned in a transverse relationship to said radial support arm and positioned at a centrally disposed angular radii covering at least 60 degrees of the casted concrete re-entrant corner to thereby serve to intercept and retard the development of stress fractures about the casted concrete re-entrant corner, and an intercepting plate attachment on the arcuate fracture intercepting plate having a wider width than the arcuate fracture intercepting plate.

6. The re-entrant corner crack inhibiting device according to claim 5, wherein the re-entrant corner crack inhibiting device is adapted for use in poured concrete walls, with said re-entrant corner crack inhibiting providing sufficient open structure when operationally attached onto the re-entrant corner of the concrete casting form so as to permit poured cement to flow thereabout and embed the device within the casted concrete re-entrant corner, wherein said intercepting plate attachment measuring at least 75% of the thickness of the casted concrete corner for which the re-entrant corner crack inhibiting device is adapted for use.

7. The re-entrant corner crack inhibiting device according to claim 5, wherein the re-entrant corner crack inhibiting device is adapted for use in poured concrete floors, with said re-entrant corner crack inhibiting providing sufficient open structure when operationally attached onto the re-entrant corner of the concrete casting form so as to permit poured cement to flow thereabout and embed the device within the casted concrete re-entrant corner, wherein said intercepting plate attachment measuring at least 75% of the thickness of the casted concrete corner for which the re-entrant corner crack inhibiting device is adapted for use.

8. The re-entrant corner crack inhibiting device according to claim 5, wherein the two legs are cornered at a right angle and the arcuate fracture intercepting plate arcuately bridges the two legs.

9. The re-entrant corner crack inhibiting device according to claim 8, wherein there is provided at least one concrete re-enforcement rod positioned between the re-entrant corner brace and the arcuate fracture intercepting plate, with said at least one concrete re-enforcement rod being positioned in a transverse relationship to the radial support arm so as to reinforce and inhibit against development of stress fractures about the casted concrete re-entrant corner.

10. The re-entrant corner crack inhibiting device according to claim 8, wherein the arcuate fracture intercepting plate includes an intercepting plate attachment having an attachment width corresponding to the casted concrete re-entrant corner thickness for which the re-entrant corner crack inhibiting device is sized to be embedded therewithin, and the intercepting plate attachment is positioned at a centrally disposed radial positioned upon said arcuate fracture intercepting plate with said arcuate fracture intercepting plate and said intercepting plate attachment collectively providing sufficient passageway to permit a flow of poured cement to fill and embed the re-entrant corner crack inhibiting device within the casted concrete re-entrant corner.

11. A method for inhibiting the development of stress fractures about a casted concrete re-entrant corner, said method comprising:

a) providing a re-entrant corner crack inhibiting device for inhibiting the development of stress fractures about the casted concrete re-entrant corner when embedded therewithin, said device comprising a re-entrant corner brace having two legs for cornering the casted concrete re-entrant corner, a radial support arm radially extending from said re-entrant corner brace onto an arcuate fracture intercepting plate, with said arcuate fracture intercepting plate being sized and positioned in a transverse relationship to said radial support arm so as to intercept and retard the development of stress fractures about the casted concrete re-entrant corner;

b) cornering the re-entrant corner brace with a re-entrant corner provided by a re-entrant corner concrete casting form;

c) pouring a wet cement mix into the re-entrant corner concrete casting form so as to embed the re-entrant corner crack inhibiting device therewithin;

d) during the wet cement mix sufficiently so as to anchor and embed the re-entrant corner crack inhibiting device with the casted concrete re-entrant corner; and e) detaching the casting form from the re-entrant corner brace to provide the casted concrete re-entrant corner having the re-entrant corner crack inhibiting device embedded therewithin so as to thereby inhibit the development of stress fractures about the casted concrete re-entrant corner.

12. The method according to claim 11, wherein the method includes providing a concrete wall casting form having at least one framing corner for casting the re-entrant corner therewith, and the arcuate fracture intercepting plate is structurally supported by the radial support arm, wherein the method further includes the steps of:

a) cornering the re-entrant corner brace to the at least one framing corner with the arcuate fracture intercepting plate being positioned so as to project into the confines of the concrete wall casting form;

b) pouring the wet cement mix into the concrete wall casting form so as to provide a wet cement mix wall structure having the re-entrant corner inhibiting device embedded therewithin;

c) allowing the wet cement mix to cure sufficiently to provide a casted concrete wall structure and d) detaching the concrete wall casting form from the re-entrant corner inhibiting device so as to thereby inhibit develop of stress fractures within the casted concrete wall structure.

13. The method according to claim 12, wherein the arcuate fracture intercepting plate forms an arc supportively bridging between the two legs of the re-entrant corner brace, and the radial support arm bisects the arc and bridges the two legs of the re-entrant corner brace.

14. The method according to claim 13, wherein the arcuate fracture intercepting plate includes a mountable intercepting plate attachment covering a radial arc of sufficient breadth to prevent stress fractures about the casted concrete re-entrant corner.

* * * * *